US006725503B1

(12) United States Patent
Lin

(10) Patent No.: US 6,725,503 B1
(45) Date of Patent: Apr. 27, 2004

(54) DOOR CLOSER HAVING DUAL OPERATING DIRECTIONS

(76) Inventor: Wu Shiong Lin, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/290,611

(22) Filed: Nov. 7, 2002

(51) Int. Cl.[7] ..... E05F 1/08
(52) U.S. Cl. ..... 16/76; 16/72; 16/54; 16/50
(58) Field of Search ..... 16/76, 70, 378, 16/54, 50, 298, 301, 300

(56) References Cited

U.S. PATENT DOCUMENTS

| | | | | | |
|---|---|---|---|---|---|
| 643,970 | A | | 2/1900 | McFeely | |
| 2,591,476 | A | * | 4/1952 | Swanson | 16/54 |
| 3,380,109 | A | * | 4/1968 | Ruiz | 16/50 |
| 3,512,212 | A | * | 5/1970 | Inoue et al. | 16/305 |
| 3,778,866 | A | * | 12/1973 | Nakanishi | 16/49 |
| 3,825,973 | A | * | 7/1974 | Gwozdz | 16/300 |
| 3,952,365 | A | * | 4/1976 | Grisebach | 16/52 |
| 3,965,533 | A | * | 6/1976 | Frohlich | 16/300 |
| 3,978,551 | A | * | 9/1976 | Mochizuki | 16/301 |
| 4,117,567 | A | * | 10/1978 | Shimizu | 16/50 |
| 4,709,445 | A | * | 12/1987 | Waldo et al. | 16/300 |
| 4,756,051 | A | * | 7/1988 | Shy | 16/50 |
| 4,783,881 | A | * | 11/1988 | Ho | 16/72 |
| 5,048,155 | A | | 9/1991 | Hwang | 16/301 |
| 5,419,013 | A | | 5/1995 | Hsiao | 16/319 |
| 5,715,574 | A | * | 2/1998 | Schall | 16/301 |

FOREIGN PATENT DOCUMENTS

| | | | |
|---|---|---|---|
| GB | 2245026 | A | * 12/1991 |
| GB | 2245311 | A | * 1/1992 |

* cited by examiner

*Primary Examiner*—Chuck Y. Mah

(57) ABSTRACT

A door closer includes a housing having one or more bulges, a shaft rotatably received in the housing and having an axle, and one or more resilient rings engaged between the shaft and the housing. The bulges of the housing may be engaged with the resilient rings for preventing the shaft from moving axially relative to the housing. An adjustable spring biasing device may apply a spring biasing force between the housing and the shaft for recovering the shaft relative to the housing. One or more spring biased projections may limit the movement between the shaft and the housing.

9 Claims, 5 Drawing Sheets

DOOR CLOSER HAVING DUAL OPERATING DIRECTIONS

BACKGROUND OF THE INVENTION

1. Field of the Invention

The present invention relates to a door closer, and more particularly to a door closer for adjustably recovering door panels moving either outwardly or inwardly.

2. Description of the Prior Art

Various kinds of typical door closers have been developed for biasing or recovering the door panels when the door panels are opened. U.S. Pat. No. 643,970 to McFeely, and U.S. Pat. No. 5,048,155 to Hwang disclose two of the typical door closers.

However, the typical door closers may be used for biasing or recovering the door panels in one direction only. For example, some of the typical door closers may be used for recovering the door panels when the door panels are opened outwardly only; and the other typical door closers may be used for recovering the door panels when the door panels are opened inwardly only.

Accordingly, the typical door closers may not be used for recovering the door panels when the door panels are openable either outwardly or inwardly. U.S. Pat. No. 5,419,013 to Hsiao discloses another typical door closer which may be adjusted to different biasing or recovering forces. However, the orifices of the members or elements may not be easily aligned with each other, and the fasteners may not be easily engaged into the orifices, such that the typical door closers may not be easily adjusted to different biasing or recovering forces.

The present invention has arisen to mitigate and/or obviate the afore-described disadvantages of the conventional door closers.

SUMMARY OF THE INVENTION

The primary objective of the present invention is to provide a door closer for adjustably recovering door panels moving either outwardly or inwardly.

The other objective of the present invention is to provide a door closer including one or more resilient rings for rotatably attaching a shaft in a housing and for preventing the shaft from moving axially relative to or along the housing.

The further objective of the present invention is to provide a door closer for easily adjusting to different biasing or recovering forces.

The still further objective of the present invention is to provide a door closer including one or more springs that may be limited to rotate relative to the housing and to be prevented from over rotated relative to the housing.

In accordance with one aspect of the invention, there is provided a door closer comprising a housing including a chamber formed therein, and including at least one bulge extended into the chamber of the housing, a shaft rotatably received in the chamber of the housing, and including an axle extended outwardly through the housing, and including an outer peripheral portion, at least one resilient ring engaged between the outer peripheral portion of the shaft and the housing. The bulge of the housing is engaged with the resilient ring for rotatably retaining the resilient ring between the housing and the shaft, and for preventing the shaft from moving axially relative to the housing. A biasing device may be engaged between the shaft and the housing for applying a spring biasing force between the housing and the shaft.

The bulge of the housing includes a depression formed therein and defined by at least one cusp, for receiving the resilient ring, the cusp is engageable with the resilient ring for preventing the resilient ring from moving axially relative to the shaft and the housing.

The shaft includes at least one recess formed in the outer peripheral portion thereof for receiving the resilient ring and for preventing the resilient ring from moving axially relative to the shaft and the housing.

The shaft includes at least one cut-off space formed therein and communicating with the depression thereof, for receiving the bulge, and for facilitating an engaging of the shaft and the resilient ring into the housing.

The biasing means includes a casing rotatably received in the chamber of the housing, and at least one spring secured between the shaft and the casing.

The housing includes an oblong hole formed therein, the casing includes a first aperture formed therein, and a pin engaged in the first aperture of the casing and received in the oblong hole of the housing and engageable with the housing for positioning the casing to the housing.

The casing includes at least one second aperture formed therein for selectively receiving the pin and for adjusting the spring biasing force of the spring between the shaft and the casing.

The shaft includes a spindle extended outwardly through the housing, and extended opposite to the axle, for selectively coupled to the linking arm device, and for selectively biasing the door panel that moves or rotated inwardly or outwardly.

A device may further be provided for limiting a rotational movement between the shaft and the housing, and includes at least one curved channel provided in the housing, and at least one spring-biased projection engaged in the shaft and slidably engaged in the curved channel of the housing for limiting the rotational movement between the shaft and the housing.

The housing includes a cap secured thereon and having a swelling extended therein and having at least one end stop formed thereon, for defining the curved channel between the cover and the housing and the shaft.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
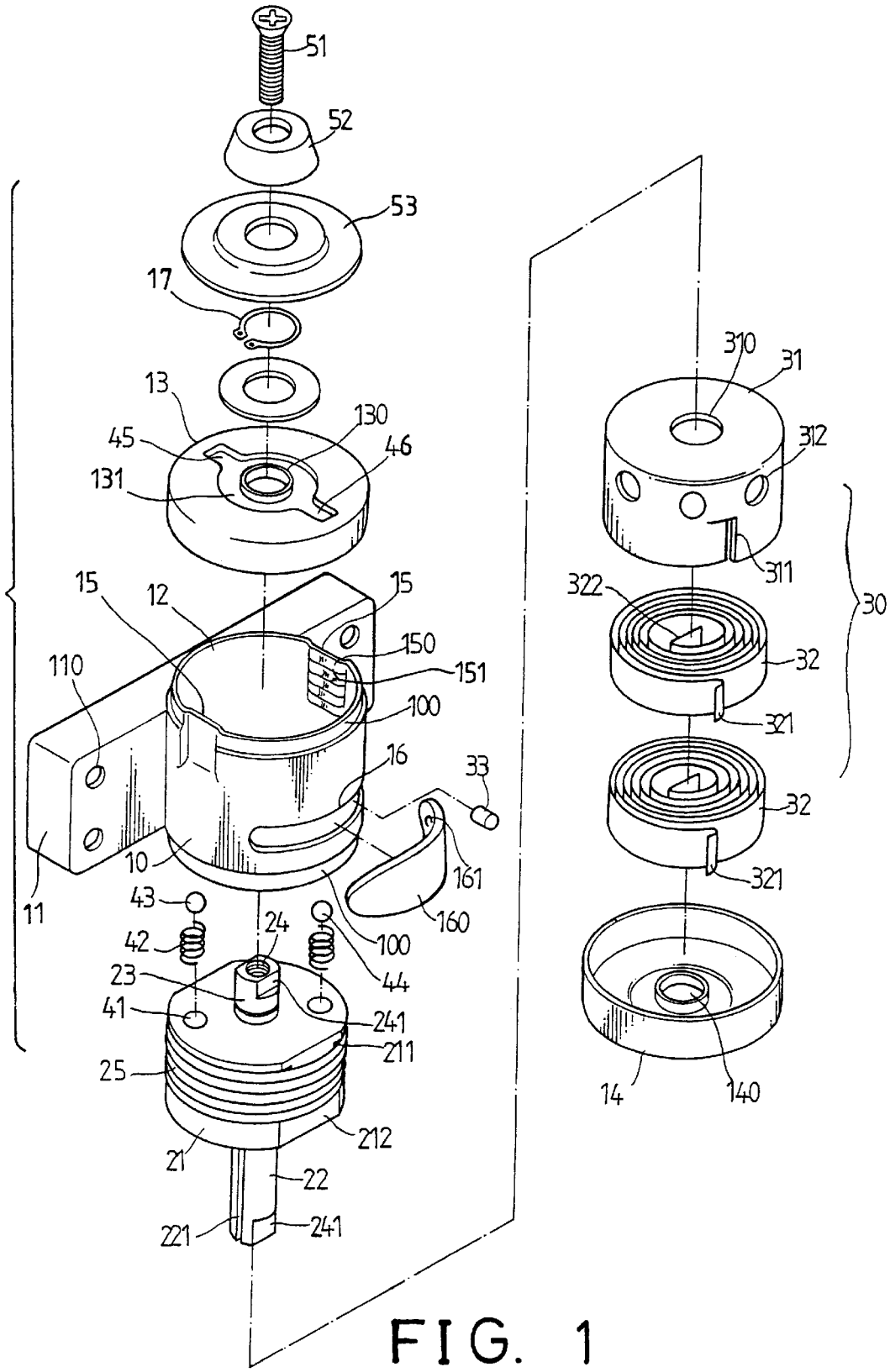
FIG. 1 is an exploded view of a door closer in accordance with the present invention.
Figure 2:
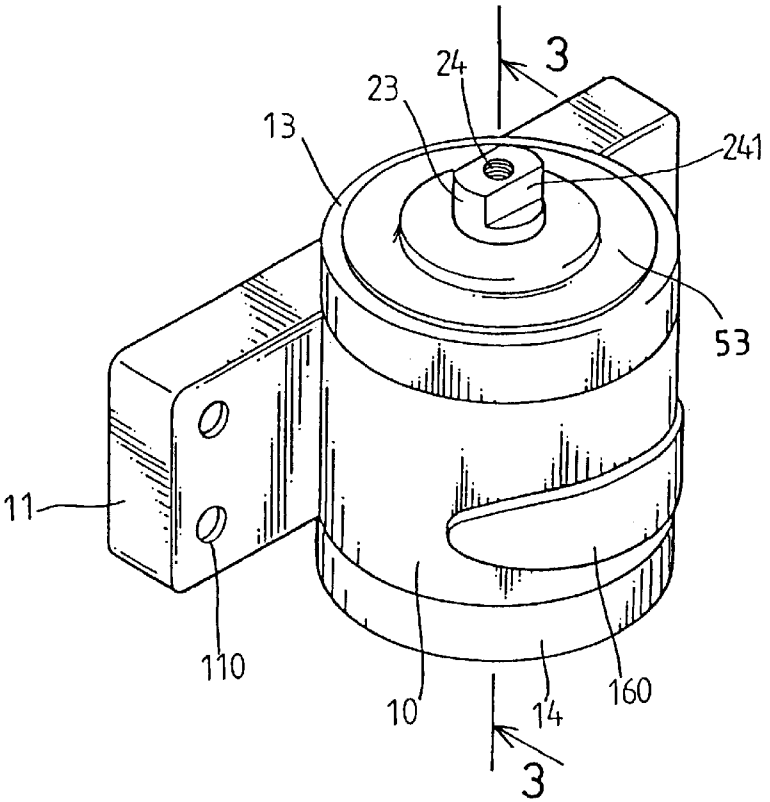
FIG. 2 is a perspective view of the door closer.

Referring to the drawings, and initially to FIGS. 1–4, a door closer in accordance with the present invention comprises a housing 10 including a board 11 provided or attached thereon and having one or more holes 110 formed therein for receiving fasteners and for securing to the door panel 70 (FIG. 8) or the like.

The housing 10 includes a chamber 12 formed therein for rotatably receiving a shaft 21 therein, and includes two peripheral recesses or shoulders 100 formed in the upper and the lower peripheral portions thereof, and includes an oblong hole 16 laterally formed in the front portion thereof.

Two covers 13, 14 have outer peripheral portions engaged onto the peripheral shoulders 100 of the housing 10 for detachably attaching onto the housing 10 with such as a force-fitted engagement. The covers 13, 14 each includes an orifice 130, 140 formed in the center portion thereof.

The housing 10 includes one or more, such as two bulges 15 extended into the chamber 12 thereof. It is preferable that the bulges 15 are oppositely extended into the chamber 12 of the housing 10, and each includes one or more depressions 150 formed or defined between cusps 151 for receiving rubber or resilient rings 25.

The shaft 21 includes one or more peripheral recesses 211 formed in the outer peripheral portion thereof for receiving the rubber or resilient rings 25 respectively, which are also received in the depressions 150 of the bulges 15, for rotatably securing the shaft 21 to the housing 10, and for preventing the shaft 21 from moving axially relative to or along the housing 10.

The typical door closers fail to teach one or more resilient rings 25 engaged between the shaft 21 and the housing 10 for rotatably securing the shaft 21 to the housing 10, and for preventing the shaft 21 from moving axially relative to or along the housing 10. A lubricating oil or the like may be filled in the chamber 12 of the housing 10 for facilitating the movement between the shaft 21 and the housing 10.

The shaft 21 includes one or more, such as two notches or cut-off spaces 212 formed therein (FIGS. 4, 5), corresponding to the bulges 15 of the housing 10, and communicating with the peripheral recesses 211 thereof, for allowing the shaft 21 to be easily engaged into the chamber 12 of the housing 10, and for allowing the resilient rings 25 to be easily engaged into the depressions 150 of the bulges 15 respectively.

Figure 4:
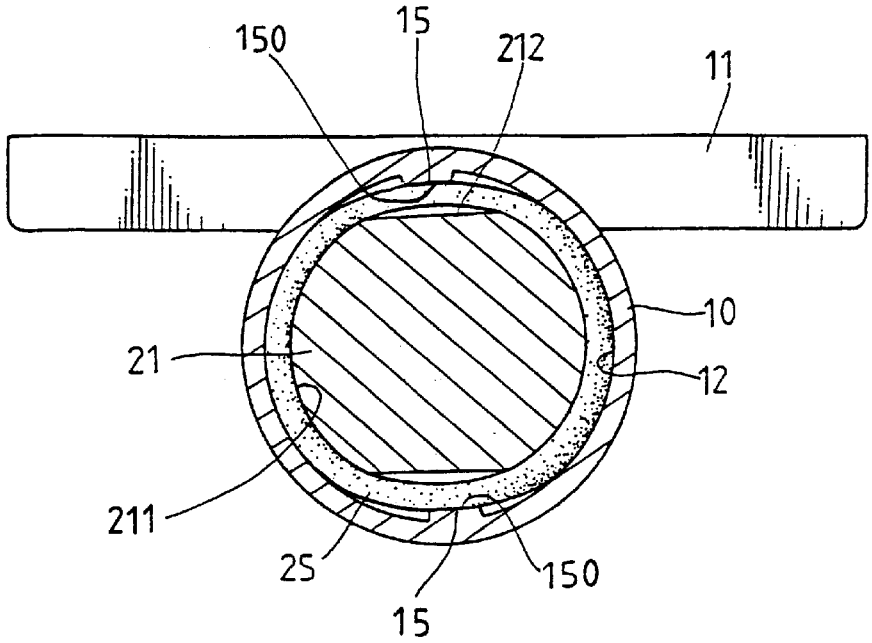
FIG. 4 is a cross sectional view taken along lines 4—4 of FIG. 3.

As shown in FIG. 4, the engagement of the resilient rings 25 in the respective depressions 150 of the bulges 15 is arranged to be good enough to rotatably secure the shaft 21 to the housing 10, and to prevent the shaft 21 from moving axially relative to or along the housing 10. The engagement of the bulges 15 with the resilient rings 25 may also be used to force the resilient rings 25 to be solidly engaged and retained in the peripheral recesses 211 of the shaft 21.

Figure 5:
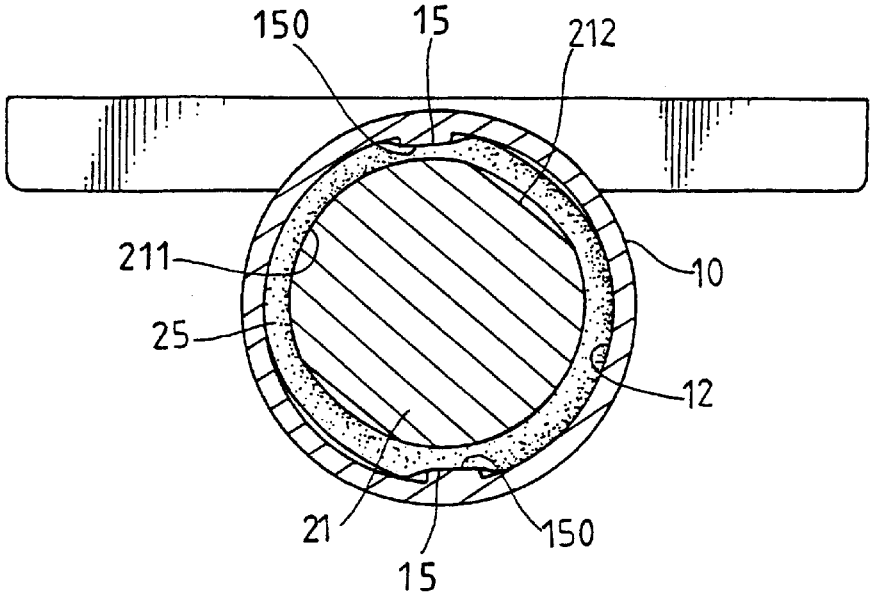
FIG. 5 is a cross sectional view similar to FIG. 4, illustrating the operation of the door closer.

As shown in FIG. 5, when the shaft 21 is rotated relative to the housing 10 to offset the cut-off spaces 212 thereof from the bulges 15 of the housing 10, the resilient rings 25 may then be solidly engaged in the respective depressions 150 of the bulges 15, for preventing the shaft 21 from moving axially relative to or along the housing 10.

The shaft 21 includes a spindle 22 and an axle 23 extended from opposite ends thereof, such as extended downwardly and upwardly respectively, and rotatably received in the orifice 140, 130 of the covers 14, 13 respectively, and/or secured to the covers 13, 14 with retaining rings 17, for further stably and rotatably retaining the shaft 21 in the housing 10.

Figure 7:
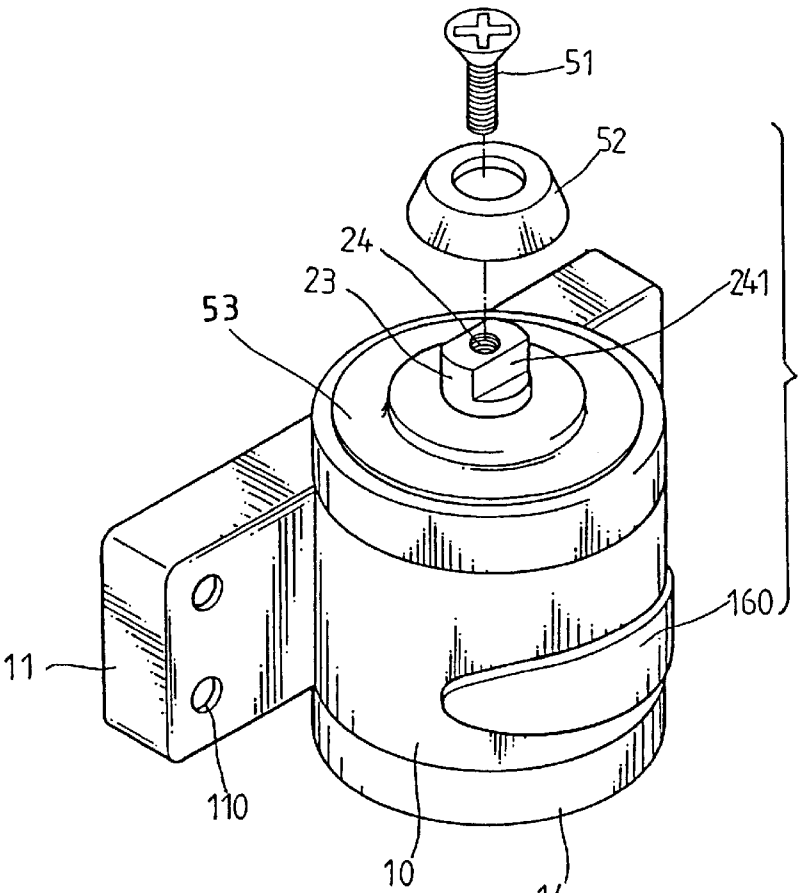
FIG. 7 is a partial exploded view illustrating the operation of the door closer.

The spindle 22 and the axle 23 each includes a screw hole 24 formed in the ends thereof for threading with fasteners 51 which may selectively secure the caps 52 and/or the lids 53 to the ends of the spindle 22 or the axle 23 (FIGS. 1, 3, 7), for shielding or protecting the ends of the spindle 22 or the axle 23 from being damaged by the other objects, particularly during transportation operations.

Figure 8:
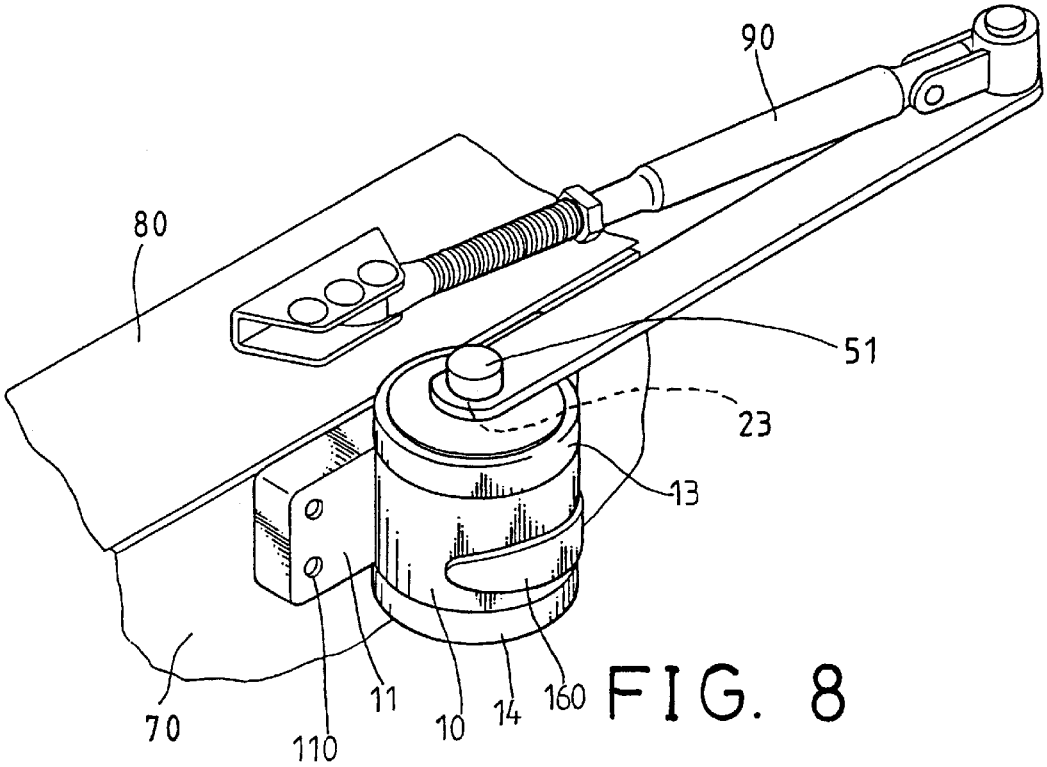
FIG. 8 is a partial perspective view illustrating the operation or the attachment of the door closer to the door panel and the door frame.

The spindle 22 and the axle 23 each includes one or more flat surfaces 241 formed in the ends thereof for solidly securing to a linking arm device 90 (FIG. 8). The linking arm device 90 may be coupled to either the spindle 22 or the axle 23, and may also be coupled to the door frame or the wall 80, and provided for biasing or recovering the door panel 70 relative to the door frame or the wall 80.

The shaft 21 is preferably disposed in the upper portion of the chamber 12 of the housing 10 (FIG. 3), and the spindle 22 is preferably received in the lower portion of the chamber 12 of the housing 10 and includes a slot 221 formed therein. A spring biasing device 30 may be received in the housing 10 and coupled between the housing 10 and the spindle 22 or the shaft 21, for biasing or recovering the shaft 21 relative to the housing 10.

The spring biasing device 30 includes one or more springs 32, such as two coil springs 32, each having an outer end 321 and an inner end 322; and includes a casing 31 having an orifice 310 formed therein for rotatably receiving the spindle 22, and for allowing the casing 31 to be rotatably received in the chamber 12 of the housing 10. The casing 31 includes a groove 311 formed in the outer peripheral portion thereof.

The inner ends 322 of the springs 32 are engaged in the slot 221 of the spindle 22, and the outer ends 321 of the springs 32 are engaged in the groove 311 of the casing 31, such that the springs 32 may be coiled or tensioned when the casing 31 is rotated relative to the housing 10, and may bias or recover the casing 31 relative to the housing 10 when the casing 31 is released.

The casing 31 includes one or more apertures 312 formed in the outer peripheral portion thereof for selectively receiving a pin 33 (FIG. 9), and for adjusting the relative position between the casing 31 and the housing 10, and thus for adjusting the spring biasing forces of the springs 32 applied between the casing 31 and the housing 10.

Figure 9:
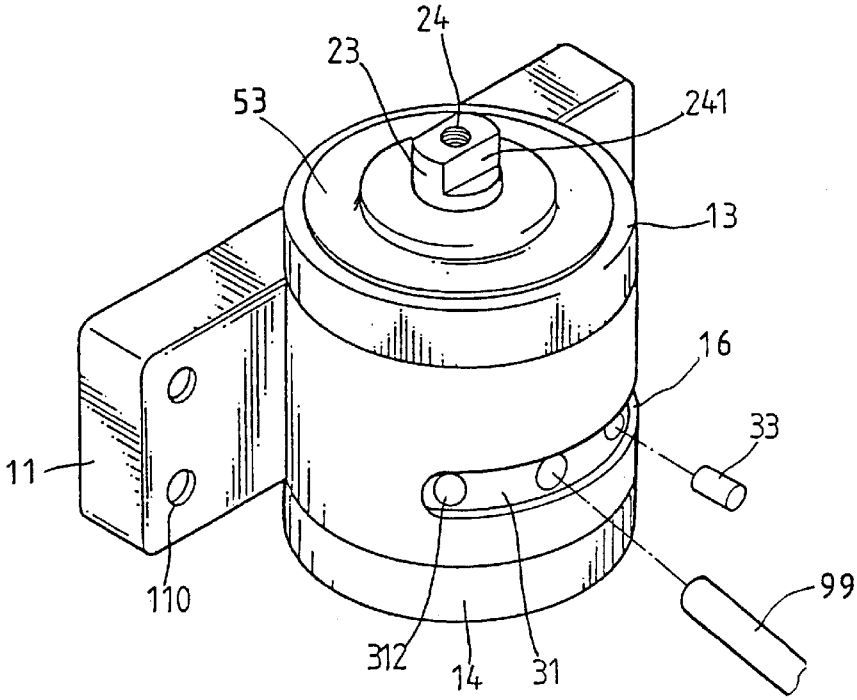
FIG. 9 is another partial exploded view illustrating the operation of the door closer.

As shown in FIG. 9, a tool 99 may be engaged into either of the apertures 312 of the casing 31, and may rotate the casing 31 relative to the housing 10, for engaging the pin 33 into the selected apertures 312. The pin 33 may be received in one end of the oblong hole 16 of the housing 10, and may engage with the housing 10, for being biased between the casing 31 and the housing 10.

A lid 160 may further be provided and includes one or more juts or latches 161 provided therein for engaging into the oblong hole 16 of the housing 10, and for engaging with the housing 10, in order to detachably secure the lid 160 to the housing 10, and so as to block the oblong hole 16 of the housing 10, and to shield the pin 16 and the casing 31.

Figure 3:
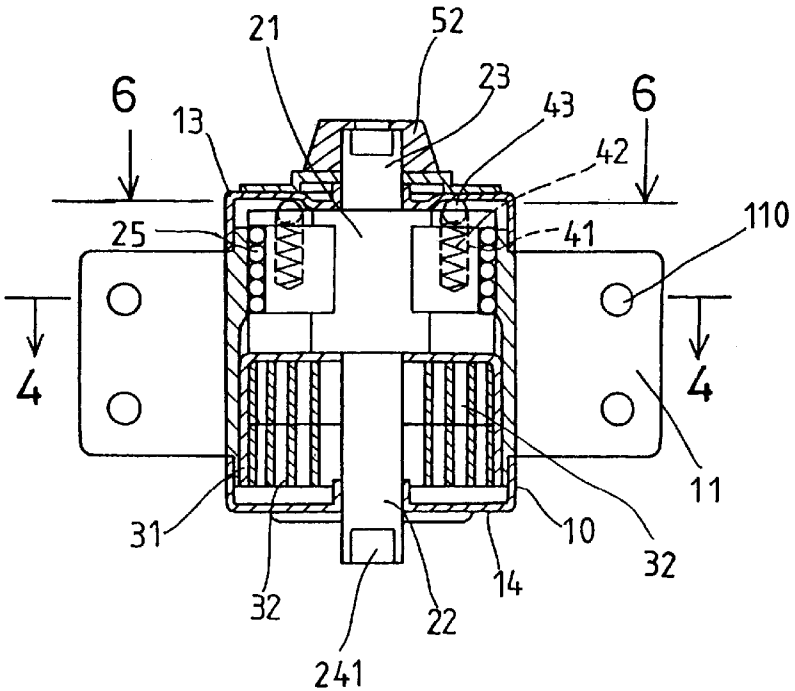
FIG. 3 is a cross sectional view taken along lines 3—3 of FIG. 2.
Figure 6:
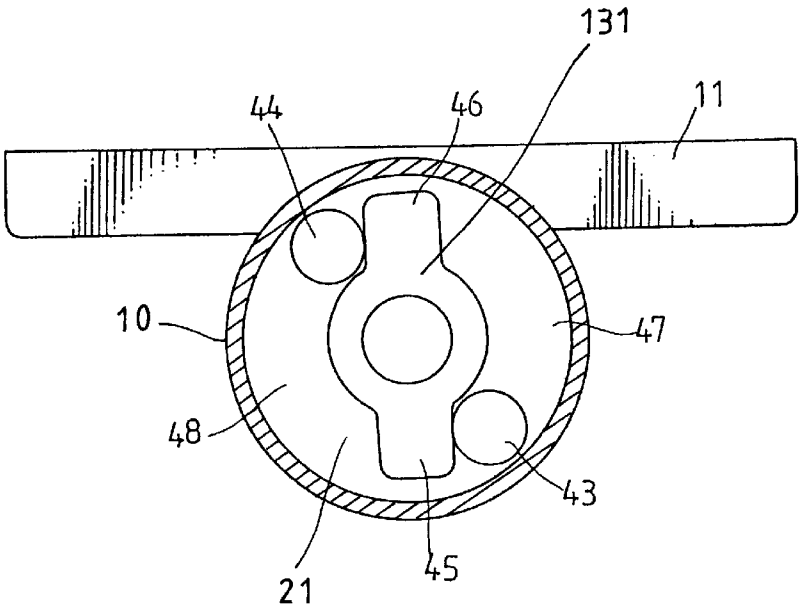
FIG. 6 is a partial cross sectional view taken along lines 6—6 of FIG. 3.

As best shown in FIGS. 1, 3 and 6, the cover 13 includes a swelling 131 extended inwardly and having two end stops 45, 46 formed and provided thereon, for forming or defining two curved channels 47, 48 between the cover 13 and the housing 10 and/or the shaft 21, or in the housing 10. The shaft 21 includes one or more cavities 41 formed therein each for receiving a spring-biased projection or a spring 42 and a ball 43 or 44 therein.

As shown in FIGS. 3 and 6, the balls or the spring-biased projections 43, 44 may be biased to be engaged in the curved channels 47, 48 of the housing 10, and may be engaged with either of the end stops 45, 46, in order to limit the relative movement between the shaft 21 and the housing 10. The curved channels 47, 48 and/or the end stops 45, 46 may be used as a limiting means for preventing the springs 32 from being over rotated relative to the housing 10.

In operation, as shown in FIG. 8, the linking arm device 90 may be coupled to the door frame or the wall 80, and may also be coupled to the axle 23, for biasing or recovering the door panel 70 relative to the door frame or the wall 80 when the door panel 70 is rotated or opened outwardly, for example.

On the contrary, the housing 10 may be secured to the door panel 70 up-side-down, and may include the spindle 22 provided on top thereof. The linking arm device 90 may then be coupled to the wall 80 and coupled to the spindle 22, for biasing or recovering the door panel 70 relative to the door frame or the wall 80 when the door panel 70 is rotated or opened inwardly, for example.

Accordingly, the door closer in accordance with the present invention may be used for adjustably recovering door panels moving either outwardly or inwardly, and may include one or more resilient rings for rotatably attaching the shaft in the housing and for preventing the shaft from moving axially relative to or along the housing. In addition, the door closer may be easily adjusted to different biasing or recovering forces against the door panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door closer comprising:

a housing including a chamber formed therein, and including at least one bulge extended into said chamber of said housing, a shaft rotatably received in said chamber of said housing, and including an axle extended outwardly through said housing, and including an outer peripheral portion, at least one resilient ring engaged between said outer peripheral portion of said shaft and said housing, said at least one bulge of said housing being engaged with said at least one resilient ring for rotatably retaining said at least one resilient ring between said housing and said shaft, and for preventing said shaft from moving axially relative to said housing, and a biasing means engaged between said shaft and said housing for applying a spring biasing force between said housing and said shaft.

2. The door closer according to claim 1, wherein said at least one bulge of said housing includes a depression formed therein and defined by at least one cusp, for receiving said at least one resilient ring, said at least one cusp is engageable with said at least one resilient ring for preventing said at least one resilient ring from moving axially relative to said shaft and said housing.

3. The door closer according to claim 1, wherein said shaft includes at least one recess formed in said outer peripheral portion thereof for receiving said at least one resilient ring and for preventing said at least one resilient ring from moving axially relative to said shaft and said housing.

4. The door closer according to claim 3, wherein said shaft includes at least one cut-off space formed therein and communicating with said at least one recess thereof, for receiving said at least one bulge, and for facilitating an engaging of said shaft and said at least one resilient ring into said housing.

5. The door closer according to claim 1, wherein said biasing means includes a casing rotatably received in said chamber of said housing, and at least one spring secured between said shaft and said casing.

6. The door closer according to claim 5 further comprising means for adjusting the spring biasing force of said at least one spring between said shaft and said casing.

7. The door closer according to claim 5, wherein said housing includes an oblong hole formed therein, said casing includes a first aperture formed therein, and a pin engaged in said first aperture of said casing and received in said oblong hole of said housing and engageable with said housing for positioning said casing to said housing.

8. The door closer according to claim 7, wherein said casing includes at least one second aperture formed therein for selectively receiving said pin and for adjusting the spring biasing force of said at least one spring between said shaft and said casing.

9. The door closer according to claim 1, wherein said shaft includes a spindle extended outwardly through said housing, and extended opposite to said axle.

* * * * *